US006065233A

United States Patent [19]

Rink

[11] Patent Number: 6,065,233

[45] Date of Patent: May 23, 2000

[54] APPARATUS FOR DISPLAYING MERCHANDISE

[76] Inventor: Joseph B. Rink, 3233 25th St., Metairie, La. 70002

[21] Appl. No.: 09/252,835

[22] Filed: Feb. 19, 1999

[51] Int. Cl.[7] ..... G09F 15/00

[52] U.S. Cl. ..... 40/607; 40/617; 211/205

[58] Field of Search ..... 248/146, 519, 248/539; 211/205, 163; 403/361, 263; 40/606, 607, 617, 612

[56] References Cited

U.S. PATENT DOCUMENTS

| | | | |
|---|---|---|---|
| 3,181,706 | 5/1965 | Mandel | 211/163 |
| 4,201,975 | 5/1980 | Marcus | 40/606 X |
| 4,865,283 | 9/1989 | Parker | 211/163 X |
| 5,283,595 | 2/1994 | Krukovsky | 40/606 X |
| 5,915,656 | 6/1999 | Grewe | 40/606 X |

*Primary Examiner*—Ramon O. Ramirez

*Attorney, Agent, or Firm*—Keaty Professional Law Corporation

[57] ABSTRACT

An apparatus for displaying merchandise, the apparatus having a base, a pole, and a means for securing the pole in a substantially vertical orientation on the base. A sign holder is preferably attached to an upper end of the pole. A bracket member is preferably secured adjacent the upper end of the pole. The bracket member has at least one prong for supporting one or more sets of disposable receptacles for umbrellas. The means for securing is preferably an insert detachably engaged within a generally cylindrical opening of the base. The insert comprises a generally cylindrical body having a generally cylindrical opening passing through at least an upper portion thereof. A plurality of longitudinal ribs extend radially outward from the body. Outer longitudinal edges of the ribs are sized to tightly abut against the generally cylindrical opening of the base to thereby maintain the insert in a substantially vertical orientation relative to the base. A portion of each of the ribs of the insert preferably taper toward a lower end of each of the ribs for facilitating insertion of the insert into the opening in the base.

19 Claims, 3 Drawing Sheets

APPARATUS FOR DISPLAYING MERCHANDISE

FIELD OF THE INVENTION

The present invention relates to devices and methods for displaying merchandise, and more particularly to devices for displaying packaged merchandise in a suspended position.

BACKGROUND OF THE INVENTION

Various types of merchandise are sold or offered to the public in a packaged form. Some items are packaged in plastic bags, with the bags secured to a common package holder. This holder can be provided with an aperture to allow suspending of the holder, and packages from a vertically elevated position.

One type of merchandise that the present invention is adapted to accommodate is disposable bags for wet umbrellas. New umbrellas are generally sold with a storage bag. The storage bag is usually made of a material similar to the material of the umbrella, such as a nylon weave, and is sized and configured to hold the umbrella when the umbrella is not in use. If the umbrella is wet from a recent rain shower, placing the umbrella in the storage bag will keep the rain water from dripping off of the umbrella and wetting the floor, where the water may dirty the floor or cause a passerby to slip.

However, because the owner of an umbrella seldom knows when he or she will need to use the umbrella, the owner will frequently, and often haphazardly, place the umbrella in a place where it will be available at a moment's notice, such as in an office desk, a purse, a brief case, the floor of a closet, the trunk of an automobile, or even the floor of an automobile. After a period of storage and use of the umbrella, the storage bag often becomes lost, and in any event is usually unavailable when needed following use of the umbrella during a rain shower.

Several years ago, the inventor developed an apparatus and method for supplying disposable receptacles for wet umbrellas. The disposable receptacles consist of an elongated plastic bag that is designed to fit over a closed umbrella. A stand was provided for displaying and dispensing the disposable receptacles. The stand consisted generally of a heavy base, a pole extending substantially vertically upward from the heavy base, and a bracket member for holding a plurality of disposable receptacles for umbrellas. Although a set of disposable receptacles for umbrellas is not particularly heavy, the uneven distribution of such sets at or near the top of a relatively long pole was sufficient to require some degree of structural support in order to maintain the pole in a substantially vertical orientation.

A number of problems and shortcomings were encountered with the arrangement of the foregoing design. In order to maintain the pole in a substantially vertical orientation, it was necessary to provide a large and heavy base. Many businesses and establishments preferred to display the stands only when needed, but the heavy base made this impracticable.

It was also thought that the stands would be more widely used if a large number of stands could be shipped to a location as needed, such as for a large meeting or convention, and then readily assembled and positioned during inclement weather. It was also discovered that because the stands were generally placed in areas of heavy foot traffic, the stands provided a potential medium for advertising. However, prior designs had failed to take advantage of the display and advertising potential of such stands. Accordingly, there is a need for an invention that overcomes the aforementioned problems and shortcomings.

OBJECTS AND SUMMARY OF THE INVENTION

It is an object of the invention to provide an improved means for supporting a pole in a substantially vertical orientation for displaying merchandise thereon.

It is another object of the invention to provide an improved apparatus for displaying merchandise, including for supplying disposable receptacles for umbrellas.

It is a further object of the invention to provide an apparatus for displaying merchandise, including for supplying disposable receptacles for umbrellas, that is easy to assemble and disassemble.

It is still another object of the invention to provide an apparatus for displaying merchandise, including for supplying disposable receptacles for umbrellas, that is light in weight.

These and other objects and advantages of the invention shall become apparent from the following general and preferred description of the invention.

Accordingly, an apparatus for displaying merchandise is provided having a base, a pole, and a means for securing the pole in a substantially vertical orientation on the base. A sign holder is preferably attached to an upper end of the pole. A bracket member is preferably secured adjacent the upper end of the pole. The bracket member has at least one prong for supporting one or more sets of disposable receptacles for umbrellas or other merchandise. The base is provided with a generally cylindrical opening extending substantially vertically into the base.

The means for securing the pole is preferably an insert detachably engaged within the generally cylindrical opening of the base. The insert comprises a generally cylindrical body having a generally cylindrical opening passing through at least an upper portion thereof. A plurality of longitudinal ribs extend radially outward from the body. Outer longitudinal edges of the ribs are sized to tightly abut against the opening in the base to thereby maintain the insert in a substantially vertical orientation relative to the base. A portion of each of the ribs of the insert preferably taper toward a lower end of each of the ribs for facilitating insertion of the insert into the opening in the base.

An end plate is formed on an upper end of the insert. The end plate preferably has a diameter greater than the opening in the base to thereby support the insert on the base. A lower end of the pole is positioned in the insert opening.

The sign holder preferably consists of at least one substantially rectangular plate. Three sides of the plate are turned inward toward a front surface of the plate to define grooves for receiving and retaining an advertising sign in the sign holder. In a preferred embodiment, the sign holder comprises a pair of the plates secured in a parallel aligned relationship to each other so as to allow positioning of two display signs on opposite sides of the sign holder. Cards with advertising or product information can be removably mounted in the sign holders.

The bracket member preferably comprises a pair of substantially L-shaped rods. One end of each of the L-shaped rods extends substantially perpendicularly from the pole, while an opposite end of each of the L-shaped rods extends in a substantially parallel relationship to the pole. An upper portion of the bracket member is preferably secured with the sign holder.

The base preferably has a substantially hollow interior. A plurality of support ribs are positioned in the hollow interior of the base. The support ribs extend radially outward from the opening in the base. Upper edges of each of the support ribs are contiguous with an interior surface of the base.

The sets of disposable receptacles for umbrellas comprise a plurality of detachable disposable receptacles secured to a receptacle holder. The receptacle holder has an aperture therethrough to allow suspending of the receptacle holder from a prong of the bracket member. Each of the receptacles for umbrellas is preferably detachable from the set of receptacles by a frangible perforated connection.

PREFERRED EMBODIMENT OF THE INVENTION

Figure 1:
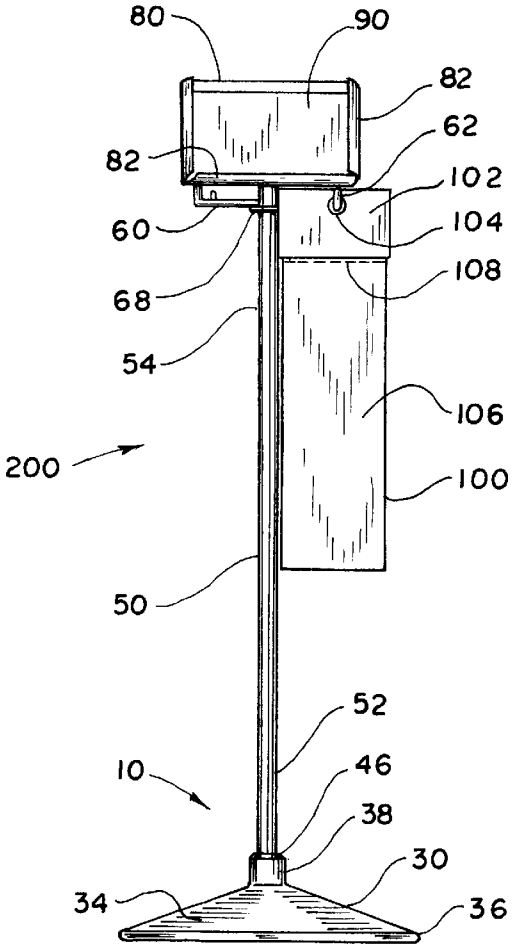
FIG. 1 is a perspective view of the display stand in accordance with the preferred embodiment of the present invention.

As shown in FIG. 1, the apparatus of the present invention is designated by numeral 200 in the drawings. The display stand 200 comprises a base 30, an upright pole 50, and a means 10 for securing the pole 50 in a substantially vertical orientation on the base 30. The means 10 for securing the pole 50 in a substantially vertical orientation is preferably an insert 10 positioned in the base 30, as will be described further below. A sign holder 80 is secured to the top of the pole 50. At least one bracket member 60 is secured on the pole 50 for suspending packaged merchandise, such as for example, receptacles, or bags 106 for wet umbrellas.

Figure 4:
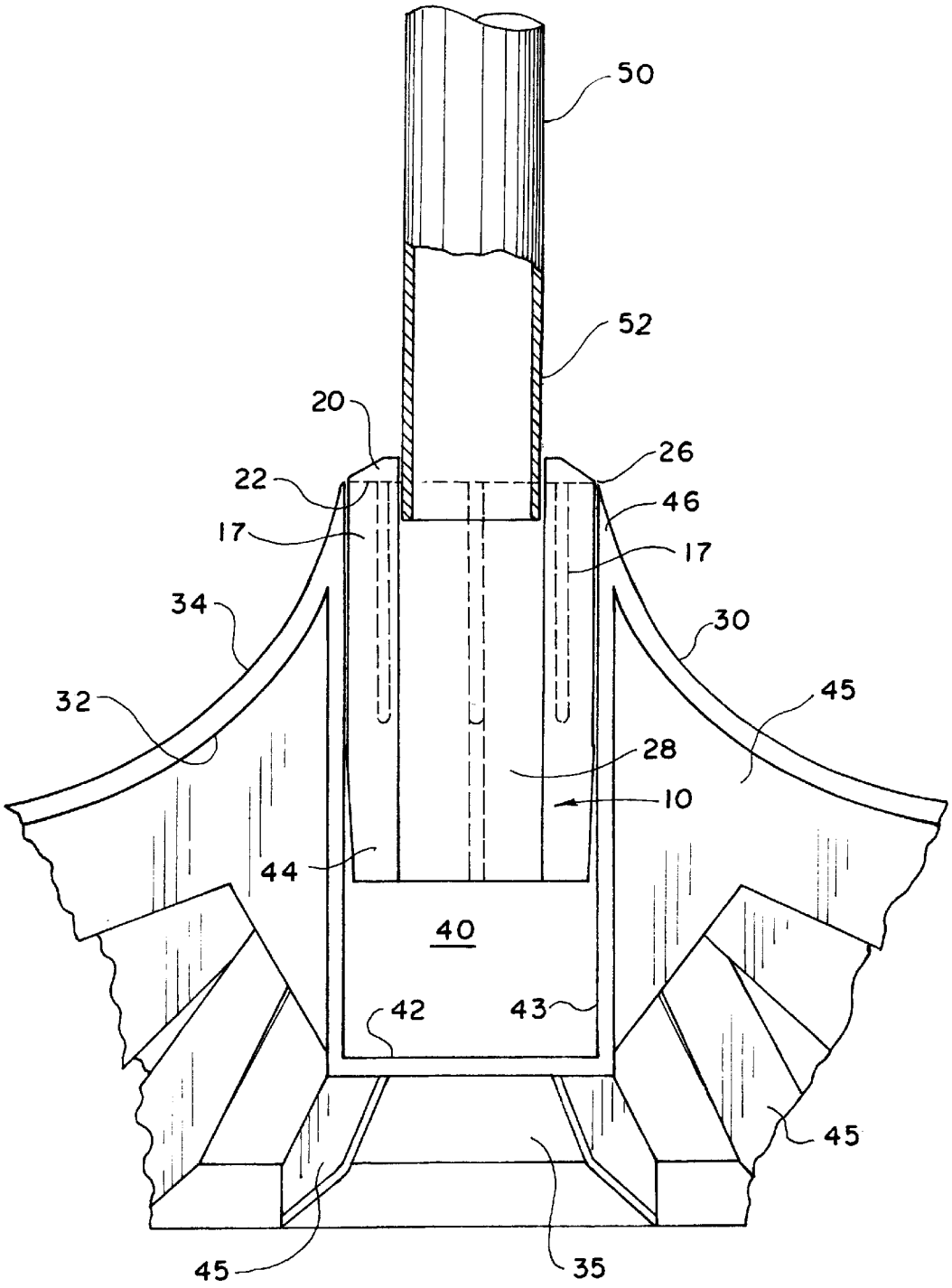
FIG. 4 is a detail cross-sectional view of the insert taken along lines A—A of FIG. 3, showing the insert in relation to the base and the vertical pole.

As shown in FIG. 4, the base 30 has a generally cylindrical opening 40 that extends substantially vertically into the base 30. The opening 40 is defined by an annular wall 43. Any of a number of configurations could be used for the base 30, provided that the base is light in weight and is capable of maintaining the cylindrical opening 40, the insert 10, and the pole 50 in a substantially vertical orientation. The configuration of the base 30 shown, in FIGS. 1 and 4 is a modified truncated cone. The base 30 has a wide bottom 36 and a reduced diameter apex 38, wherein the opening 40 is formed. This configuration provides a stable base, minimizes the volume required for the base, and is esthetically pleasing.

In the preferred embodiment shown in FIG. 4, the annular wall 43 that defines the opening 40 is coaxial with the base 30. In this embodiment, the upper end 46 of the opening forms a support for the insert 10, allowing an enlarged circular lip 26 of the plate 20 to rest thereon when all members of the display stand 200 are assembled for use.

In order to minimize the weight of the base 30, the base has a substantially hollow interior 35. In order to provide additional support to the base 30, particularly in view of the minimization of weight and materials used in forming the base, it is preferable to provide the interior 35 of the base 30 with a plurality of support ribs 45. The support ribs 45 preferably extend radially outward from the base opening 40. In a preferred embodiment, the support ribs 45 are contiguous with the exterior surface 44 of the opening 40. Additionally, in a preferred embodiment, upper edges of the support ribs 45 are contiguous with an interior surface 32 of the base 30.

The insert 10 is positioned in the opening 40 of the base 30. The insert 10 is preferably detachably engaged within the cylindrical opening 40 of the base, but it can alternatively be fixedly attached to the wall 43. As shown most clearly in FIGS. 2 and 3, the insert comprises a generally cylindrical body 16. The body 16 has a generally cylindrical opening 28 passing longitudinally through at least an upper end 14 thereof. In the embodiment shown in FIGS. 2–4, the generally cylindrical opening 28 passes entirely through the body 16.

Figure 3:
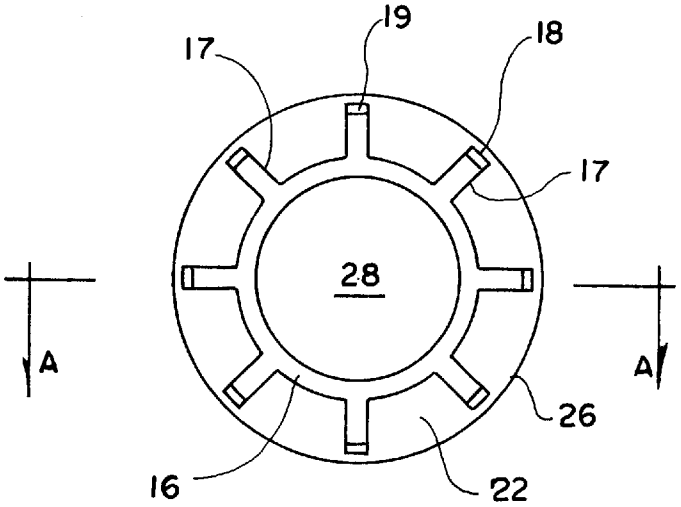
FIG. 3 is a bottom view of the insert of FIG. 2.
Figure 2:
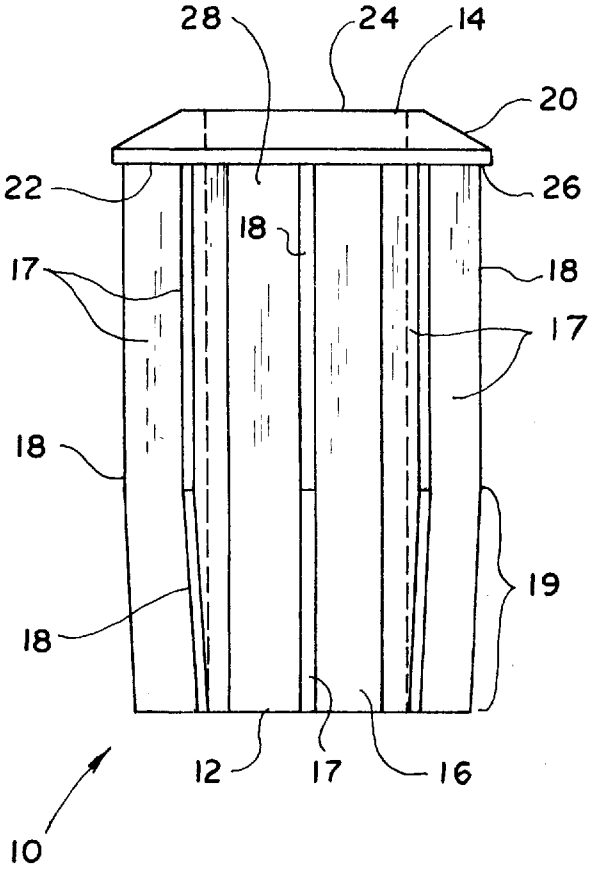
FIG. 2 is a detail front view of the insert member of the apparatus of the present invention.

As shown in FIGS. 2–4, a plurality of longitudinal ribs 17 extend radially outward from the body 16. As shown in FIG. 4, the outer longitudinal edges 18 of the ribs 17 are sized to tightly abut against the interior wall 43 of the generally cylindrical opening 40 of the base 30, to thereby maintain the insert 10 in a substantially vertical orientation relative to the base 30. In the preferred embodiment shown in FIGS. 2 and 3, a portion 19 of each of the ribs 17 of the insert 10 taper toward a lower end 12 of each of the ribs 17. The tapered end 19 of the insert 10 facilitates insertion of the insert 10 into the opening 40 in the base 30.

An end plate 20 is preferably formed on an upper end 14 of the insert 10. The end plate 20 has a en enlarged diameter lip or flange 26 with a diameter greater than the opening 40 in the base 30 to thereby support the insert 10 on the base 30. A lower surface 22 of the end plate 20 is preferably contiguous with the upper ends of the ribs 17. As shown most clearly in FIG. 3, the lip, or flange 26 of the end plate 20 extends beyond the edges 18 of the ribs 17, providing a support 26 for supporting the insert 10 on the upper end 46 of the opening 40 of the base 30, as shown in FIG. 4.

The pole 50 is sized to tightly fit within the opening of the insert 10. A lower end 52 of the pole 50 is positioned in the opening 28 in the upper portion 12 of the insert 10. With the insert 10 positioned in the opening 40 of the base 30, the pole 50 extends substantially vertically upward from the base 30. As indicated in FIG. 4, when the circumference of the pole 50 is properly sized relative to the circumference of the insert opening 28, the lower end 52 of the pole 50 may be inserted only a relatively short distance into the upper portion 12 of the insert opening 28, yet still maintain the pole 50 in a substantially vertical orientation.

A sign holder 80 is secured to an upper end 54 of the pole 50. In the preferred embodiment shown in FIGS. 1 and 5, the sign holder 80 consists of at least one substantially rectangular plate 80. Three sides 82 of the plate 80 are turned inward toward a front surface of the plate 82. The inwardly turned sides 82 define grooves for receiving and retaining a sign in the sign holder 80. The sign holder shown in FIG. 5 comprises a pair of substantially rectangular plates 80. The pair of the plates 80 are preferably secured in a parallel aligned relationship to each other so as to allow positioning of display signs 90 on opposite side, of the sign holder 80. A sign 90 can be removably mounted in the sign holder 80 by sliding the sign 90 into the grooves for receiving and retaining the sign 90.

A bracket member 60 is secured adjacent the upper end 54 of the pole 50. In the preferred embodiment shown in FIGS. 1 and 5, the bracket member 60 comprises a pair of substantially L-shaped rods 60. One end of each of the L-shaped rods 60 extends substantially perpendicularly from the pole 50. This end of the L-shaped rod 60 can be secured to the pole 50, such as by welding. To provide further support for the bracket member, a ring 68 can be mounted about the pole 50. The ring 68 can be welded to the pole 50, and an end of the L-shaped rod 60 can be secured on top of the ring 68, such as by welding.

An opposite end of each of the L-shaped rods 60 extends in a substantially parallel relationship to the pole 50. In the embodiment shown in FIG. 5, the bracket member 60 further comprises an upper portion 63 (shown in phantom lines) that is secured to the sign holder 80. In the embodiment shown in FIG. 5, the upper portion 63 of the bracket member 60 is sandwiched between back surfaces of the plates 80. The back surfaces of the plates 80 can be secured to the upper portion 63 of the bracket member 60, such as by welding.

Figure 5:
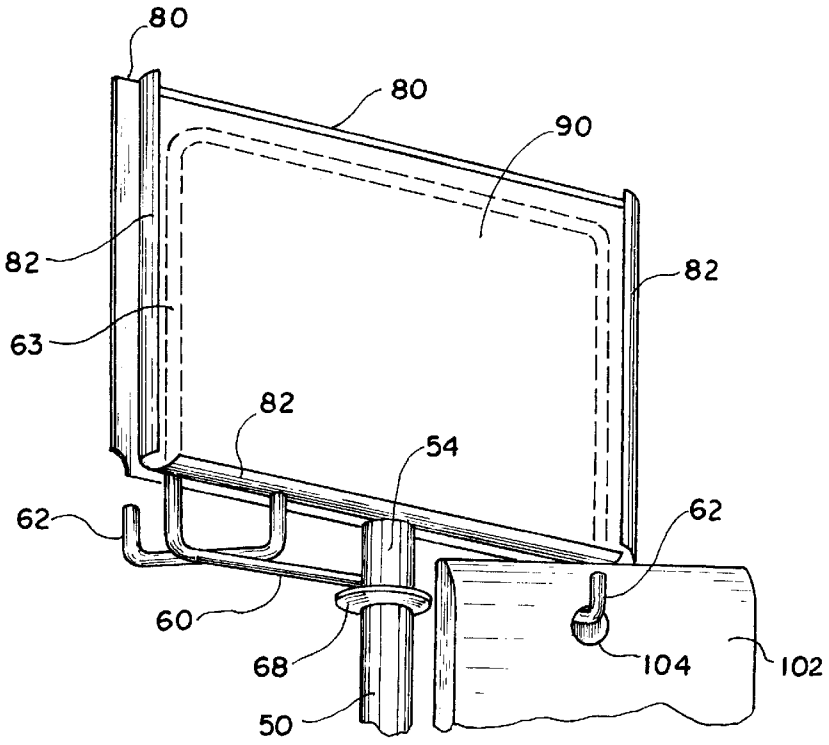
FIG. 5 is a detail view of the sign holder, which forms a part of the apparatus of the present invention.

As shown most clearly in FIG. 5, the bracket member 60 has at least one prong 62 positioned below the sign holder 80 for supporting one or more sets of disposable receptacles for umbrellas 100. In the embodiment shown in FIG. 5, the prongs 62 are formed from a pair of elongated U-shaped members. The elongated U-shaped members are secured on the horizontal portions of the L-shaped rods 60 such that prongs 62 are provided on either side of the bracket member 60.

As shown in FIG. 1, the apparatus is preferably provided with at least one set of disposable receptacles for umbrellas 100. In a preferred embodiment, each set 100 comprises a plurality of detachable disposable receptacles 106. The disposable receptacles 106 are similar to plastic bags, but are elongated so as to fit a closed umbrella. A set of large sized receptacles can be provided for large umbrellas, and a set of small sized receptacles can be provided for small umbrellas. The plurality of disposable receptacles 106 preferably extend from a receptacle holder 102.

In a preferred embodiment, the receptacle holder 102 is a piece of light weight cardboard that is folded over one end of a plurality of disposable receptacles 106 and secured in place by staples. The receptacle holder 102 has an aperture 104 therethrough to allow the set of receptacles 100 to be suspended from a prong 62 of the bracket member 60, as shown in FIGS. 1 and 5. In a preferred embodiment, each of the receptacles for umbrellas 106 is detachable from the set of receptacles 100 by a frangible perforated connection 108.

In operation, the apparatus of the invention can be stored or shipped in a disassembled condition. When it is desirable to set up the apparatus, the base 30 is positioned on a flat surface, such as a floor, with the opening 40 of the base 30 facing upward. The insert 10 is then positioned in the opening 40 of the base. The lower end 52 of the pole 50 is then inserted into the upper portion 14 of the insert opening 28. Alternatively, the lower end 52 of the pole can first be inserted into the upper portion 14 of the insert opening 28, and the insert 10 is then positioned in the opening 40 in the base 30.

With the pole 50 thus secured in a substantially vertical orientation relative to the base 30 and the floor, a sign 90, such as a sign bearing an advertisement, can be displayed in the sign holder. One or more sets of receptacles for umbrellas 100 can be suspended from the prongs 62, thereby supplying passers-by with a ready source of receptacles for storing wet umbrellas. When it is desired to disassemble the apparatus for storage or shipment, the above steps are reversed.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

I claim:

1. An apparatus for displaying merchandise comprising:

a base, a pole, a means for securing said pole in a substantially vertical orientation on aid base, a means for suspending merchandise from said pole and a sign holder attached to said pole, said base being provided with a generally cylindrical opening extending substantially vertically into said base; said means for securing said pole being an insert detachably engaged within said opening of the base, said insert comprising a generally cylindrical body, said body having a generally cylindrical opening passing through at least an upper portion thereof, a plurality of longitudinal ribs extending radially outward from said body, outer longitudinal edges of said ribs being sized to tightly abut against said generally cylindrical opening of said base to thereby maintain said insert in a substantially vertical orientation relative to said base; said pole being sized to tightly fit within said opening of said insert, a lower end of said pole being positioned in said insert opening; said sign holder being attached to an upper end of said pole.

2. The apparatus of claim 1, further comprising a bracket member secured adjacent said upper end of said pole, said bracket member having at least one prong for supporting one or more sets of disposable receptacles for umbrellas below said sign holder.

3. The apparatus of claim 2, further comprising a ring mounted about said pole for supporting said bracket member on said pole.

4. The apparatus of claim 2, wherein a portion of each of said ribs of said insert taper toward a lower end of each of said ribs for facilitating insertion of said insert into said opening in said base.

5. The apparatus of claim 2, further comprising an end plate formed on an upper end of said insert, said end plate having a diameter greater than said opening in said base to thereby support said insert on said base.

6. The apparatus of claim 2, wherein said sign holder consists of at least one substantially rectangular plate, three sides of said plate being turned inward toward a front surface of said plate to define grooves for receiving and retaining a sign in said sign holder.

7. The apparatus of claim 6, wherein a pair of said plates are secured in a parallel aligned relationship to each other so as to allow positioning of display signs on opposite sides of the sign holder.

8. The apparatus of claim 2, further comprising a sign removably mounted in said sign holder.

9. The apparatus of claim 2, wherein said bracket member comprises a pair of substantially L-shaped rods, one end of each said L-shaped rods extending substantially perpendicularly from said pole, an opposite end of each said L-shaped rods extending in a substantially parallel relationship to said pole.

10. The apparatus of claim 9, wherein said bracket member further comprises an upper portion secured to said sign holder.

11. The apparatus of claim 10, wherein said sign holder comprises a pair of substantially rectangular plates, three sides of each of said plates being turned partially inward toward a front surface of each of said plates to define grooves for receiving and retaining a sign against said front surface of each of said plates, said upper portion of said bracket member being sandwiched between back surfaces of said plates.

12. The apparatus of claim 2, wherein said base has a substantially hollow interior.

13. The apparatus of claim 12, wherein said base further comprises a plurality of support ribs positioned in said substantially hollow interior of said base, said support ribs extending radially outward from said opening in said base.

14. The apparatus of claim 13, wherein upper edges of each of said support ribs are contiguous with an interior surface of said base.

15. The apparatus of claim 2, further comprising at least one set of disposable receptacles for umbrellas, said at least one set comprising a plurality of detachable disposable receptacles secured to a receptacle holder, said receptacle holder having an aperture therethrough to allow suspending of said receptacle holder from said at least one prong of said bracket member.

16. The device of claim 15, wherein each of said receptacles for umbrellas is detachable from said set of receptacles by a frangible perforated connection.

17. An apparatus for displaying merchandise comprising:

a base, a pole, a means for securing said pole in a substantially vertical orientation on said base, and a bracket member secured adjacent an upper end of said pole, said bracket member having at least one prong for supporting one or more sets of disposable receptacles for umbrellas;

wherein said base is provided with a generally cylindrical opening extending substantially vertically into said base;

said means for securing is an insert detachably engaged within said general cylindrical opening of said base, said insert comprising a generally cylindrical body, said body having a generally cylindrical opening passing through at least an upper portion thereof, a plurality of longitudinal ribs extending radially outward from said body, outer longitudinal edges of said ribs being sized to tightly abut against said generally cylindrical opening of said base to thereby maintain said insert in a substantially vertical orientation relative to said base;

said pole being sized to tightly fit within said opening of said insert, a lower end of said pole being positioned in said insert opening; and a sign holder being attached to said upper end of said pole.

18. The apparatus of claim 17, wherein a portion of each of said ribs of said insert taper toward a lower end of each of said ribs for facilitating insertion of said insert into said opening in said base.

19. The apparatus of claim 17, further comprising an end plate formed on an upper end of said insert, said end plate having a diameter greater than said opening in said base to thereby support said insert on said base.

* * * * *